US005119944A

United States Patent [19]

Milton

[11] Patent Number: 5,119,944

[45] Date of Patent: Jun. 9, 1992

[54] GRAVITY FEED MERCHANDISE APPARATUS

[75] Inventor: Merl Milton, New York, N.Y.

[73] Assignee: Marlboro Marketing, Inc., New York, N.Y.

[21] Appl. No.: 708,347

[22] Filed: May 31, 1991

[51] Int. Cl.[5] ..... A47F 5/00

[52] U.S. Cl. ..... 211/59.2; 211/104

[58] Field of Search ..... 211/59.2, 59.3, 105, 211/104, 202; 312/42, 45, 72, 246, 250

[56] References Cited

U.S. PATENT DOCUMENTS

| | | | |
|---|---|---|---|
| 1,658,744 | 2/1928 | Snyder | 211/104 X |
| 1,704,011 | 3/1929 | Mark | 211/105 X |
| 2,128,781 | 8/1938 | Lister et al. | 211/59.3 X |
| 2,129,122 | 9/1938 | Follett | 211/59.3 |
| 2,562,982 | 8/1951 | Cieri | 211/1.3 X |
| 2,584,179 | 2/1952 | Adams | 211/105 |
| 3,490,603 | 1/1970 | Willer | 211/202 |
| 4,174,781 | 11/1979 | Hupalowsky | 211/59.2 |
| 4,651,883 | 3/1987 | Gullett et al. | 211/59.2 |

*Primary Examiner*—Robert W. Gibson, Jr.

[57] ABSTRACT

A gravity feed merchandise apparatus for display and dispensing of consumer product items, e.g. in first-in-first-out manner, is formed of a plurality of side by side units, each having a holder with a vertical series of gravity feed product chutes open at one side for ready access, and a suspension mechanism to mount the holder on a support for independent movement from a retracted display and dispensing position to an extended, open access restocking position. The units may be added or removed to conform to the allotted aisle width of a retail area, for efficient use of the retail space.

17 Claims, 4 Drawing Sheets

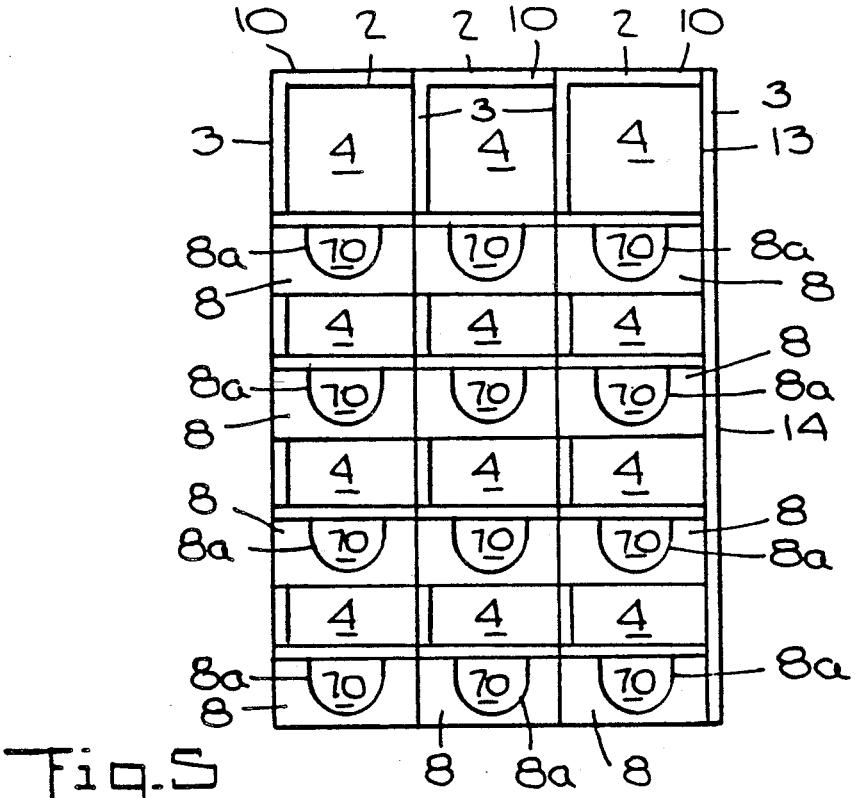
Fig. 5
Fig. 6
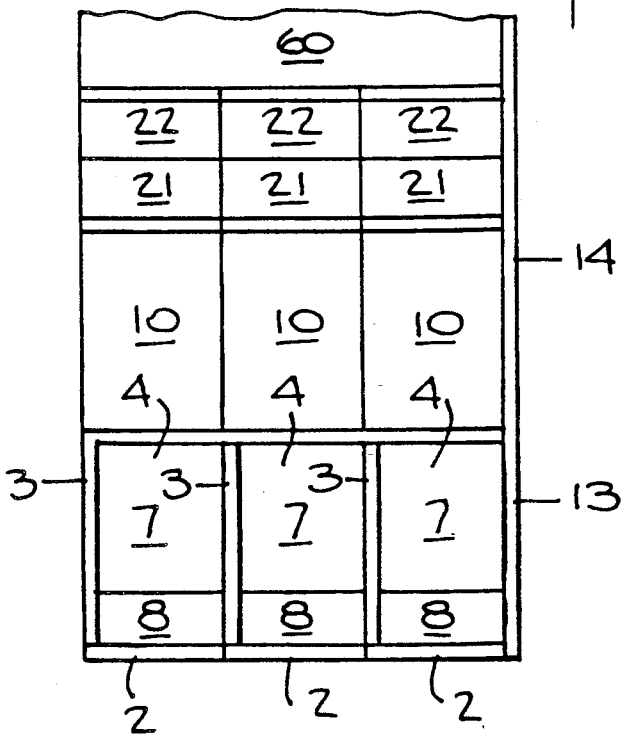

GRAVITY FEED MERCHANDISE APPARATUS

FIELD AND BACKGROUND OF THE INVENTION

The present invention relates to a gravity feed merchandise apparatus, and more particularly to such an apparatus for display and dispensing of consumer product items, e.g. in first-in-first-out manner, that is formed of a plurality of side by side units, each having a holder with a vertical series of gravity feed product chutes open at one side for ready access, and a suspension mechanism to mount the holder on a support for independent movement from a retracted display and dispensing position to an extended, open access restocking position.

Known constructions that display and dispense merchandise items in a retail shopping area, e.g. along an aisle of a drug store, supermarket, etc., often involve gravity feed units in which the product items are fully exposed on an inclined stationary shelf, taking up extra space, fostering random selection and making restocking difficult as the old items must be rearranged at the front of the shelf before adding fresh stock therebehind to favor selection of the old items first. Orderly restocking is important with food and like items that deteriorate with age.

Other known gravity feed units provide the product items on an inclined, drawer-like, single pull-out shelf arranged to expose only the front items to foster their orderly selection first, but this requires a cumbersome drawer-slide type construction to enable the shelf to be slid out to expose from above its rear portion for restocking thereat.

These known units are mainly permanent and inflexible, with shelves of prefixed aisle width that limit side by side accommodation thereon of different product item types, and adjustment of the display width to match variations in allotted aisle width.

While it is desired to arrange these units for attractive product item display and ready access by consumers, yet conform the units to varying width retail areas, existing constructions do not provide versatile combination arrangements, changeable in width pattern to accommodate a mixture of differing width side by side product items along a given aisle width of the retail area.

A need exists for a merchandise apparatus to display and dispense consumer product items, that overcomes these drawbacks, and permits consumer access for orderly item dispensing as well as ready access for efficient restocking, e.g. in first-in-first-out manner, utilizing any desired number of units of the same or different width in side by side arrangement, each storing and displaying given size items in compact, segregated arrangement.

SUMMARY OF THE INVENTION

It is an object of the invention to overcome prior art drawbacks, and to provide a merchandise apparatus for display and dispensing of consumer product items that permits consumer access for orderly item dispensing as well as ready access for efficient restocking, especially in first-in-first-out manner, utilizing any desired number of units of the same or different width in side by side arrangement, e.g. along a given aisle width of a retail shopping area, for optimized use of the allotted space, with each unit being capable of storing and displaying given size tems in compact, segregated arrangement.

It is another object of the invention to provide such an apparatus that is simple and inexpensive in construction, readily fabricated, and robust and long wearing in use.

According to the invention, a gravity feed merchandise apparatus for display and dispensing of consumer product items is provided, which comprises a holder, e.g. of the type used to display merchandise items for consumer access in a retail shopping area, and a retractable and extensible suspension mechanism that is adapted to mount the holder on a support.

The holder has a series of downwardly and forwardly inclined gravity feed product chutes, arranged vertically one above the other, each including a normally recessed upper rear loading portion and an exposed lower front display and dispensing portion for consumer access to product items loaded thereon.

The suspension mechanism, that mounts the holder on the support, is arranged to suspend the holder for movement relative to the support from a normally retracted display and dispensing position adjacent the support to an extended position remote from the support for direct access to the chute loading portions to restock the chutes thereat with product items. The suspension mechanism may be a lever linkage, e.g. arranged to move the holder along a generally horizontal path.

In one preferred form, the linkage comprises a holder linear guide connected to the holder, a support linear guide adapted to be connected to the support to mount the holder and linkage thereon, and a holder lever arm and a support lever arm pivotally interconnected intermediate their corresponding ends.

The holder arm has a fixed pivot end connected by a fixed pivot to the holder guide and a movable pivot end provided with a support keeper operatively connected to the support guide to form a movable pivot movable linearly along the support guide. The support arm has a fixed pivot end connected by a fixed pivot to the support guide and a movable pivot end provided with a holder keeper operatively connected to the holder guide to form a movable pivot movable linearly along the holder guide.

Upon pulling the holder forwardly from retracted to extended position the arms rotate from a generally aligned relation in which the mechanism is retracted, the fixed pivots are adjacent each other and the movable pivots are adjacent each other and correspondingly remote from the fixed pivots, to a crosswise relation in which the mechanism is extended, the fixed pivots are remote from each other and the movable pivots are remote from each other and correspondingly adjacent the fixed pivots.

The guides may have retaining tracks to receive captively the corresponding keepers for linear movement therealong. The keepers may be separate members pivoted to the corresponding movable pivot ends of the arms and having slide portions for reception by and coaction with the corresponding guide tracks.

The holder may comprise a vertical side panel that supports the series of chutes at one lateral side of the chutes while the opposite lateral side thereof remains exposed for ready access to restock the chutes when the holder is moved to extended position.

In the installed arrangement, a support is provided, e.g. in the retail shopping area, such as a stationarily positioned support, and the support guide is connected thereto to mount the holder and linkage thereon. Generally, a plurality of, e.g. modular or selective width, chute assembly units is provided, that are mounted in side by side relation on the support, each unit having a said holder and a said suspension mechanism to extend and retract the holder independently of the other units.

BRIEF DESCRIPTION OF THE DRAWINGS

Other objects of the invention will become apparent from the within specification and accompanying drawings, in which:

FIG. 5 is a front view of the units of FIG. 4, all in retracted position; and

FIG. 6 is a top view of the units shown in FIG. 5.

DESCRIPTION OF THE PREFERRED EMBODIMENTS

Figure 1:
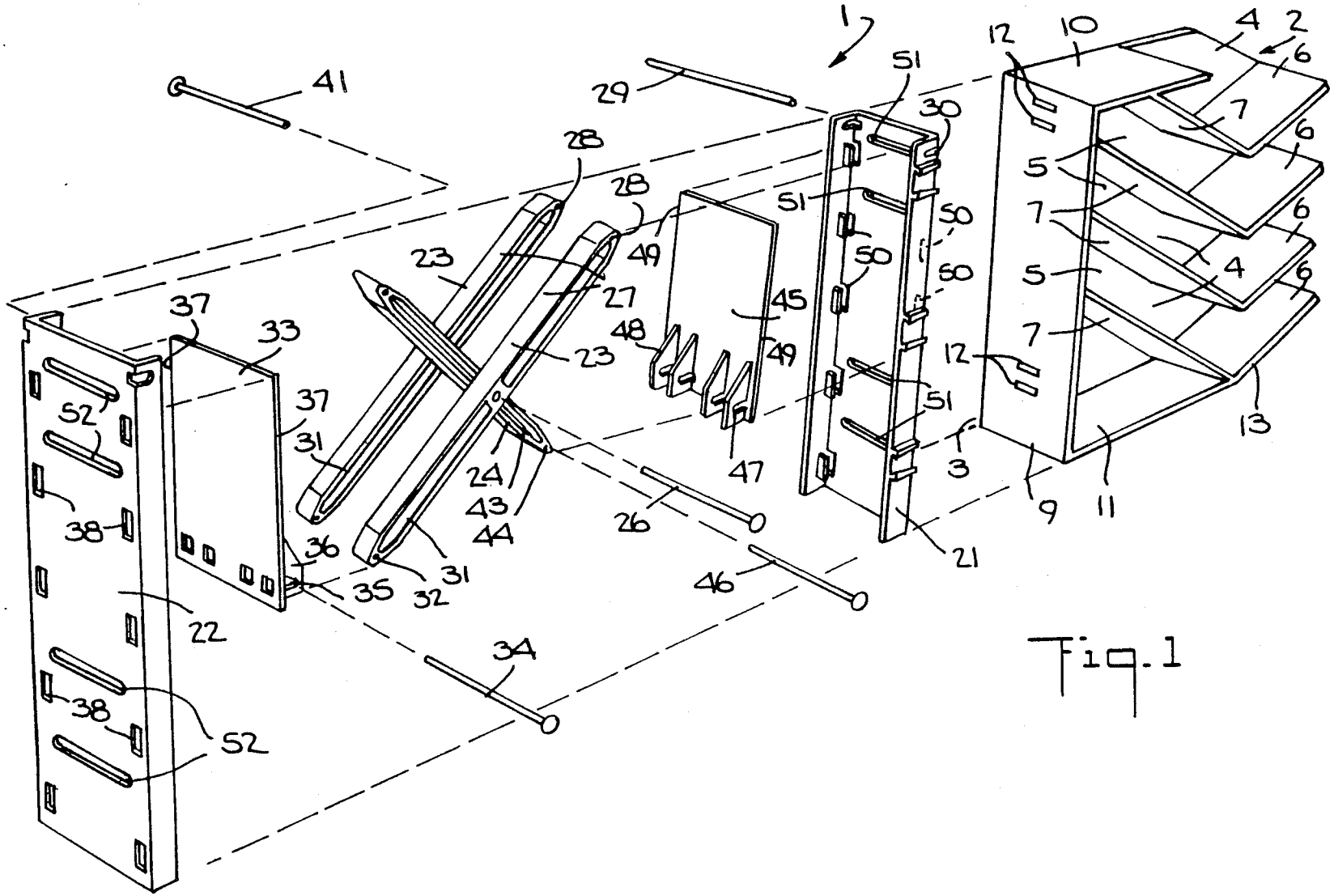
FIG. 1 is a perspective exploded view of a gravity feed merchandise apparatus unit for display and dispensing of consumer product items according to one embodiment of the invention.
Figure 2:
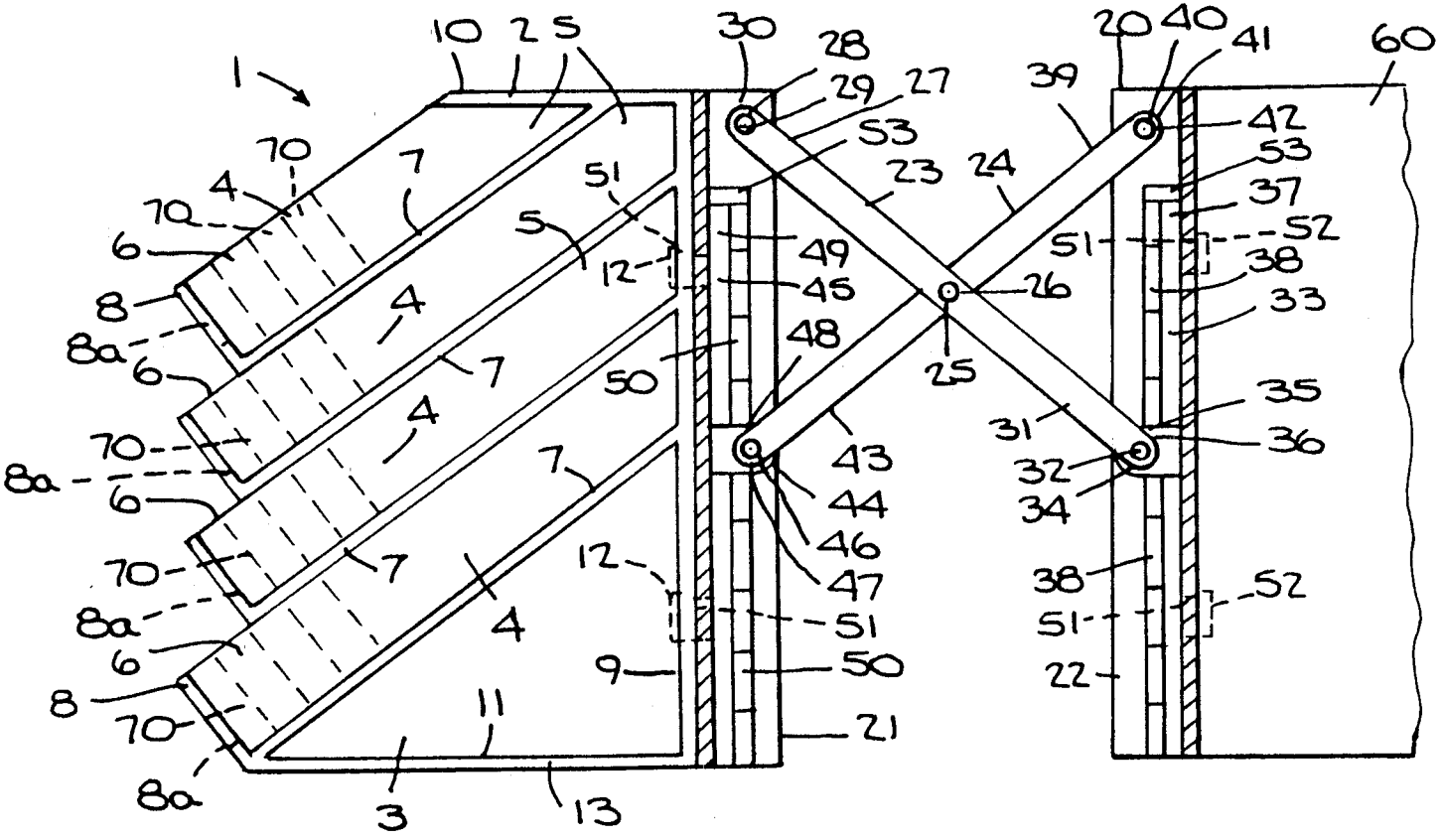
FIG. 2 is a side view, partially in section, showing the assembled apparatus unit of FIG. 1 in extended position.
Figure 3:
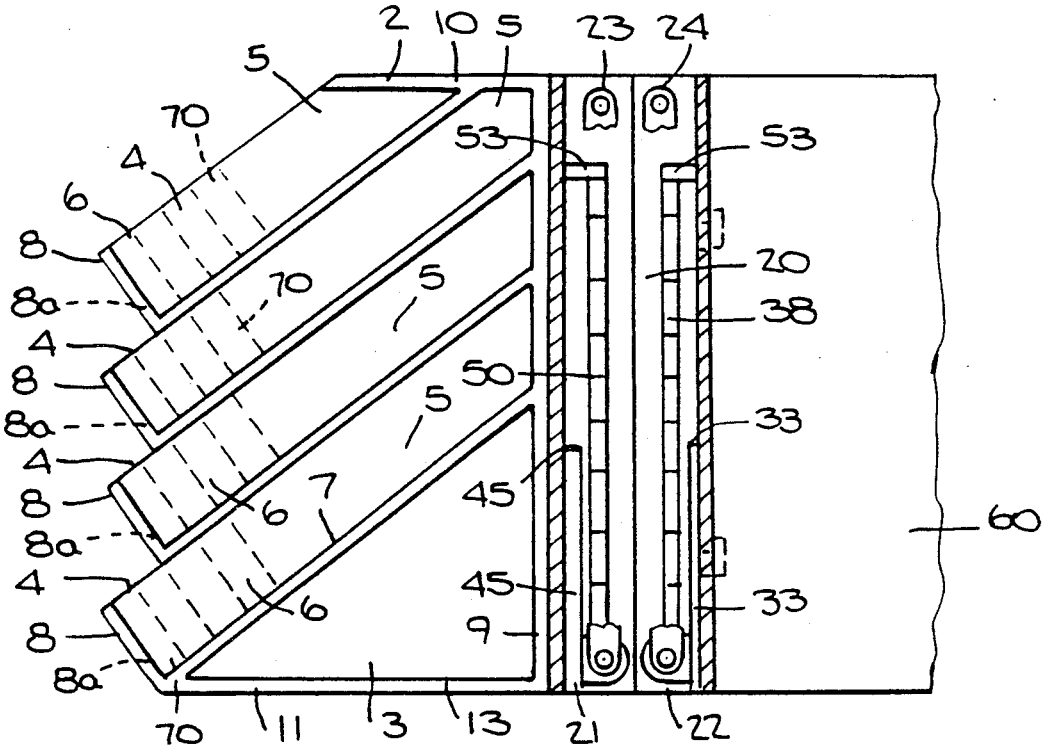
FIG. 3 is a view, similar to FIG. 2, showing the unit in retracted position.

Referring to the drawings, and initially to FIGS. 1-3, a gravity feed merchandise apparatus or chute assembly unit 1 for consumer product item display and dispensing is shown, according to one embodiment of the invention. Unit 1 includes a holder 2, e.g. to display small, box-like merchandise items for consumer access in a retail shopping area, and a retractable and extensible suspension mechanism such as a lever linkage 20, to mount holder 2 on a, e.g. stationarily positioned, support 60, such as a wall or conventional gondola, in the retail area (FIGS. 2-3).

Holder 2 has a vertical side panel 3 that supports a series of, e.g. four, downwardly and forwardly inclined gravity feed product chutes 4, arranged vertically one above the other. Each chute 4 includes a normally recessed upper rear loading portion 5 and an exposed lower front display and dispensing portion 6 for consumer access to product items 70 loaded thereon (shown in phantom in FIGS. 2-3), and is formed of a bottom ramp wall 7 and a front retainer wall 8. Front wall 8 of each chute 4 may be transparent for ease in identifying the items 70 loaded thereon and may have an edge cut-out portion 8*a* to facilitate manual removal of the front-most item 70 from the given chute 4.

Holder 2 also has a vertical rear mounting panel 9, a horizontal top cover panel 10 and a horizontal bottom closure panel 11, which with side panel 3 form an upright, open side box-like structure, that is provided with connectors 12 on rear panel 9 to mount holder 2 on linkage 20, and that has a fully open access side 13 laterally opposite side panel 3.

Linkage 20 not only mounts holder 2 on support 60 but also is arranged to suspend holder 2 for movement relative to support 60, e.g. along a generally horizontal path, from a normally retracted display and dispensing position adjacent support 60 (FIG. 3) to an extended position remote from support 60 for direct access to loading portions 5 of chutes 4 for restocking chutes 4 thereat with items 70 via open side 13 (FIG. 2).

Linkage 20 includes a holder linear guide 21 that is connected to holder 2, a support linear guide 22 that is connected to support 60 to mount holder 2 and linkage 20 thereon, plus at least one holder lever arm 23 (two being shown in FIG. 1) and at least one support lever arm 24 (one being shown in FIG. 1) that are pivotally interconnected intermediate their corresponding ends, e.g. at a center pivot 25 by a center pin 26.

Each holder arm 23 has a fixed pivot end 27 connected at a fixed pivot 28 by a common fixed pin 29 to holder guide 21 at composite offset pin seat 30, and a movable pivot end 31 provided with a common support keeper 33, e.g. a separate slide plate, operatively connected to support guide 22 to form a movable pivot 32 movable linearly along support guide 22. For this purpose, each holder arm 23 is connected at its movable pivot 32 by a common movable pin 34 to composite offset pin seat 35 in extension portion 36 of support keeper 33. Support keeper 33 has opposed side edge slide portions 37 captively received in and that coact with opposed retaining tracks 38 on support guide 22.

Similarly, support arm 24 has a fixed pivot end 39 connected at a fixed pivot 40 by fixed pin 41 to support guide 22 at composite offset pin seat 42, and a movable pivot end 43 provided with a holder keeper 45, e.g. a separate slide plate, operatively connected to holder guide 21 to form a movable pivot 44 movable linearly along holder guide 21. For this purpose, support arm 24 is connected at movable pivot 44 by a movable pin 46 to composite offset pin seat 47 in extension portion 48 of holder keeper 45. Holder keeper 45 has opposed side edge slide portions 49 captively received in and that coact with opposed retaining tracks 50 on holder guide 21.

Holder guide 21 has counterpart connectors 51 that engage connectors 12 on rear panel 9 to mount holder 2 removably on guide 21 in known manner. Support guide 22 has counterpart connectors 52 that engage connectors (not shown) on support 60 to mount guide 22 removably on support 60 in like known manner.

As is clear from FIGS. 2-3, upon pulling holder 2 forwardly from retracted to extended position, arms 23 and 24 rotate from a generally aligned relation in which linkage 20 is retracted, fixed pivots 28 and 40 are adjacent each other and movable pivots 32 and 44 are adjacent each other and correspondingly remote from fixed pivots 28 and 40, to a crosswise relation in which linkage 20 is extended, fixed pivots 28 and 40 are remote from each other and movable pivots 32 and 44 are remote from each other and correspondingly adjacent fixed pivots 28 and 40.

During such movement between retracted and extended position, keepers 45 and 33 move linearly along guides 21 and 22 by sliding coaction of slide portions 49 of keeper 45 with tracks 50 of guide 21 and of slide portions 37 of keeper 33 with tracks 38 of guide 22. Maximum extended position is determined by a stop 53 (FIGS. 2-3) located at a suitable point on each of tracks 50 and 38 of guides 21 and 22 to prevent further upward linear movement of keepers 45 and 33 relative to guides 21 and 22.

Linkage 20 constitutes a scissors-like mechanism that fully supports holder 2 orthogonally in stable manner in both retracted and extended position. Fixed pivots 28 and 40 and their pin seats 30 and 42, and movable pivots 32 and 44 and their pin seats 35 and 47, are arranged relative to center pivot 25 and to each other, for unhindered movement of holder guide 21 from generally flush contact relation with support guide 22 when holder 2 is in retracted position, to horizontally forwardly spaced relation with support guide 22 when holder 2 is in extended position.

While the plate member form of keepers 45 and 33, pivoted to movable pivot ends 44 and 31,31 of arms 24 and 23,23 and captively slidably arranged in guides 21 and 22, as shown, enhances the stability of unit 1 when in extended position, any other suitable means may be used to provide keepers correspondingly pivoted to the movable pivot ends of arms 24 and 23,23 and operatively connected to guides 21 and 22 to form movable pivots movable linearly therealong. For instance, the movable pivot ends of the arms may have laterally extending transverse pivot pins as keepers captively received in coacting tracks on the guides for such linear movement while providing stable support for holder 2.

As vertical side panel 3 supports the series of chutes 4 at only one lateral side while the opposite lateral side 13 remains exposed, there is ready access for restocking chutes 4 with items 70 when holder 2 is in extended position (FIG. 2). When holder 2 is in retracted position (FIG. 3), the close vertical positioning of chutes 4, one above the other, confines consumer access to the frontmost item 70 in each chute 4, assuring the taking of the oldest item 70 first, for first-in-first-out overall dispensing.

Figure 4:
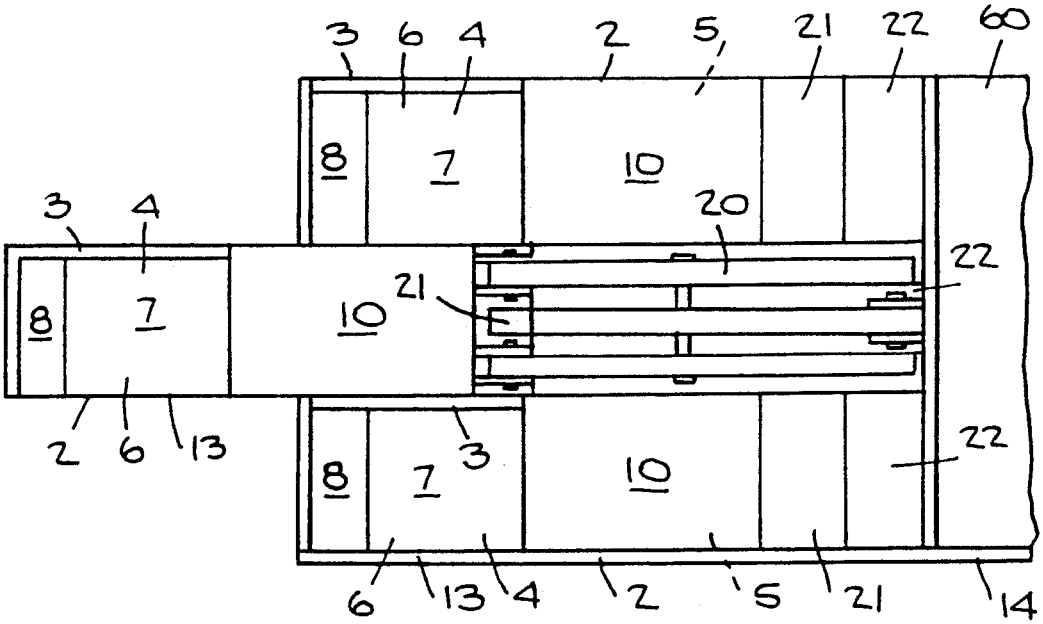
FIG. 4 is a top view showing a plurality of the apparatus units in side by side relation, with one unit in extended position and the remaining units in retracted position.

As shown in FIGS. 4–6, in the installed arrangement, e.g. in the retail shopping area, a plurality of, e.g. modular, chute assembly units 1, each having a holder 2 and linkage 20, may be mounted side by side on support 60 in attractive orderly fashion. All items 70 are compactly arranged in each chute 4 for individual first-in-first-out gravity feed dispensing. Each chute 4 in a unit 1 is closely vertically arranged relative to the others, for maximizing use of the space in the unit 1. Providing each front wall 8 of transparent material and with a cut-out portion 8*a* enhances visibility of and across to the items 70 on its chute 4.

Despite the close side by side relation of the units 1 used to fill the alloted aisle width, each unit 1 can extend and retract independently of the others, affording unhindered access to loading portions 5 at the open side 13 of its holder 2 for restocking when extended. Support 60 may have a dummy panel 14 adjacent the open side 13 of the end-most unit 1 of the arrangement to close off its chutes 4 from the facing aisle space.

While the units 1 are shown in FIGS. 4–6 as being of common or modular width, each can be of any desired width. As they can be readily removed from and added to support 60 via support guide connectors 52, different width units 1 can be used in mixed combination width patterns along an alloted aisle width to display and dispense different width items 70 at the same site.

Thus, in a mixed arrangement, one unit 1 may display and dispense cigarette packages of various brands segregated among its chutes 4, another unit 1 may display and dispense cigar packages of various brands segregated among its chutes 4, and a further unit 1 may display and dispense pipe tobacco packages of various brands segregated among its chutes 4. ALso, the different width units 1 may display and dispense boxed panty hose and related packaged items, over-the-counter medicines, e.g. flat-boxed analgesics, cold and allergy products and related items, cosmetics and related items, small boxed candy, packaged mints, single pack candy bars and related items, and the like.

The construction of units 1 is superior to conventional shelves or trays that display and dispense merchandise items. Use of holders 2 with a vertical arrangement of gravity feed chutes 4 open at one side, permits a plurality of units 1 of like or different width, that accommodate a variety of like or different width items 70 in their associated vertical series of chutes 4, to be assembled side by side as a collective display of any overall width, adjustable in width at any time in single package increments based on the width of the given units 1 and associated type items 70, to fill any allotted aisle width by merely removing or adding units 1 of like or different width.

Individual units 1 can be extended, free of adjacent units 1, for restocking. As the chutes 4 are completely exposed at the open side 13 of each holder 2, first-in-first-out product stocking and dispensing is assured. As the chutes 4 of each unit 1 are in compact, segregated vertical series arrangement, maximum density gravity feed use of the allotted aisle space is attained.

Use of lever linkage 20 as suspension mechanism provides a scissors-like orthogonal lever system permitting holder 2 to be pulled away from support guide 22, that serves as mounting plate for mounting unit 1 on support 60, along a path perpendicular to the mounting surface of support guide 22 and to the counterpart mounting surface of support 60. The holder 2 of each unit 1 may be pulled free of adjoining units 1 without disturbing them, yet remains fully supported in stable manner in extended position.

As linkage 20 has horizontal axis pivots, the vertical extent of unit 1 readily accommodates arms 23 and 24 when holder 2 is retracted, and keepers 45 and 33 when holder 2 is extended. The movement amplitude of keepers 45 and 33 along guides 21 and 22 is such that when the holder 2 of a unit 1 is extended, it clears the front walls 8 of adjacent units 1 sufficiently for ready access at its open side 13 to its loading portions 5 to restock its chutes 4 with fresh items 70 behind any old items 70.

The vertical arrangement of chutes 4 on units 1 fosters immediate access to items 70 in front facing view at front walls 8. Units 1 are mounted on support 60 at a height suitably within the range of consumer view and access, and extend side by side along a straight horizontal line (in plan view), where support 60 has a flat vertical mounting surface. However, depending on the design of the vertical mounting surface of support 60, units 1 may extend side by side in a different configuration, e.g. along a curved or irregular horizontal line (in plan view), where the mounting surface of support 60 is so curved or irregular. In all cases, units 1 provide the above described advantages.

Holders 2 and linkages 20 may be made of any suitable material or adequate structural strength to achieve the functional purposes of units 1, such as metal, plastic or wood.

The invention thus provides a gravity feed merchandise apparatus for display and dispensing of consumer product items that permits efficient pattern width use of the allotted aisle space, and that is simple and inexpensive in construction, readily fabricated, and robust and long wearing in use.

This specification and drawings are set forth by way of illustration and not limitation, and various modifications may be made therein without departing from the spirit of the invention which is to be limited solely by the scope of the claims.

What is claimed is:

1. Gravity feed merchandise apparatus for display and dispensing of consumer product items, comprising a holder having a series of downwardly and forwardly inclined gravity feed product chutes, arranged vertically one above the other, each including a normally recessed upper rear loading portion and an exposed lower front display and dispensing portion for consumer access to product items loaded thereon, and a retractable and extensible suspension mechanism, adapted to mount the holder on a support, and arranged for suspending the holder for movement relative to said support from a normally retracted display and dispensing position adjacent said support to an extended position remote from said support for direct access to the loading portions of the chutes for restocking the chutes thereat with product items.

2. Apparatus of claim 1 wherein the mechanism comprises a lever linkage.

3. Apparatus of claim 2 wherein the linkage is arranged for movement of the holder along a generally horizontal path.

4. Apparatus of claim 3 wherein the linkage comprises a holder linear guide connected to the holder, a support linear guide adapted to be connected to a said support to mount the holder and linkage thereon, and a holder lever arm and a support lever arm pivotally interconnected intermediate their corresponding ends, the holder lever arm having a fixed pivot end connected by a fixed pivot to the holder linear guide and a movable pivot end provided with a support keeper operatively connected to the support linear guide to form a movable pivot movable linearly along the support linear guide, and the support lever arm having a fixed pivot end connected by a fixed pivot to the support linear guide and a movable pivot end provided with a holder linear keeper operatively connected to the holder linear guide to form a movable pivot movable linearly along the holder guide, such that upon pulling the holder forwardly from retracted to extended position the arms rotate from a generally aligned relation in which the mechanism is retracted, the fixed pivots are adjacent each other and the movable pivots are adjacent each other and correspondingly remote from the fixed pivots, to a crosswise relation in which the mechanism is extended, the fixed pivots are remote from each other and the movable pivots are remote from each other and correspondingly adjacent the fixed pivots.

5. Apparatus of claim 4 wherein the guides include retaining tracks for captively receiving the corresponding keepers for linear movement therealong.

6. Apparatus of claim 5 wherein the keepers are separate members pivotally connected to the corresponding movable pivot ends of the arms and having slide portions for reception by and coaction with the corresponding guide tracks.

7. Apparatus of claim 4 wherein a support is provided, and the support guide is connected thereto to mount the holder and linkage thereon.

8. Apparatus of claim 7 wherein the support is stationarily positioned.

9. Apparatus of claim 1 wherein the holder comprises a vertical side panel supporting the series of chutes at one lateral side of the chutes while the opposite lateral side of the chutes remains exposed for ready access to restock the chutes when the holder is moved to extended position.

10. Gravity feed merchandise apparatus for display and dispensing of consumer product items, comprising a support, and a plurality of chute assembly units mounted in side by side relation on the support, each unit comprising a holder having a series of downwardly and forwardly inclined gravity feed product chutes, arranged vertically one above the other, each including a normally recessed upper rear loading portion and an exposed lower front display and dispensing portion for consumer access to product items loaded thereon, and a retractable and extensible suspension mechanism connected to the support to mount the holder thereon, and arranged for suspending the holder for movement relative to said support from a normally retracted display and dispensing position adjacent said support to an extended position remote from said support for direct access to the loading portions of the chutes for restocking the chutes thereat with product items.

11. Apparatus of claim 10 wherein in each unit the mechanism comprises a lever linkage.

12. Apparatus of claim 11 wherein in each unit the linkage is arranged for movement of the holder along a generally horizontal path.

13. Apparatus of claim 12 wherein in each unit the linkage comprises a holder linear guide connected to the holder, a support linear guide connected to said support to mount the holder and linkage thereon, and a holder lever arm and a support lever arm pivotally interconnected intermediate their corresponding ends, the holder lever arm having a fixed pivot end connected by a fixed pivot to the holder linear guide and a movable pivot end provided with a support keeper operatively connected to the support linear guide to form a movable pivot movable linearly along the support linear guide, and the support lever arm having a fixed pivot end connected by a fixed pivot to the support linear guide and a movable pivot end provided with a holder keeper operatively connected to the holder linear guide to form a movable pivot movable linearly along the holder linear guide.

such that upon pulling the holder forwardly from retracted to extended position the arms rotate from a generally aligned relation in which the mechanism is retracted, the fixed pivots are adjacent each other and the movable pivots are adjacent each other and correspondingly remote from the fixed pivots, to a crosswise relation in which the mechanism is extended, the fixed pivots are remote from each other and the movable pivots are remote from each other and correspondingly adjacent the fixed pivots.

14. Apparatus of claim 13 wherein in each unit the guides include retaining tracks for captively receiving the corresponding keepers for linear movement therealong.

15. Apparatus of claim 14 wherein in each unit the keepers are separate members pivotally connected to the corresponding movable pivot ends of the arms and having slide portions for reception by and coaction with the corresponding guide tracks.

16. Apparatus of claim 10 wherein the support is stationarily positioned.

17. Apparatus of claim 10 wherein in each unit the holder comprises a vertical side panel supporting the series of chutes at one lateral side of the chutes while the opposite lateral side of the chutes remains exposed for ready access to restock the chutes when the holder is moved to extended position.

* * * * *